US007267110B2

(12) United States Patent
Tetsuka

(10) Patent No.: US 7,267,110 B2
(45) Date of Patent: Sep. 11, 2007

(54) FUEL INJECTION CONTROL DEVICE FOR INTERNAL COMBUSTION ENGINE

(75) Inventor: Takashi Tetsuka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/506,845

(22) Filed: Aug. 21, 2006

(65) Prior Publication Data

US 2007/0044770 A1 Mar. 1, 2007

(30) Foreign Application Priority Data

Aug. 23, 2005 (JP) ..... 2005-241567

(51) Int. Cl.
*F02D 41/06* (2006.01)

(52) U.S. Cl. ..... 123/491; 123/436

(58) Field of Classification Search ..... 123/491, 123/436; 701/103–105
See application file for complete search history.

(56) References Cited

U.S. PATENT DOCUMENTS 5,979,413 A * 11/1999 Ohnuma et al. ..... 123/491
6,568,371 B2 * 5/2003 Sato et al. ..... 123/478
6,568,373 B2 * 5/2003 Yuya et al. ..... 123/491
6,571,775 B2 * 6/2003 Sato et al. ..... 123/491
6,578,551 B2 * 6/2003 Yuya et al. ..... 123/436
7,124,743 B2 * 10/2006 Gonzales et al. ..... 123/491

FOREIGN PATENT DOCUMENTS

JP 01-2805654 A 10/1989

* cited by examiner

*Primary Examiner*—Hai Huynh
(74) *Attorney, Agent, or Firm*—Birch, Stewart, Kolasch & Birch, LLP

(57) ABSTRACT

A fuel injection control device for a more stable carburetion condition by setting an adequate fuel injection prohibition period at the start of an internal combustion engine. A fuel injection control device includes an injection switch which selectively switches among simultaneous injection which is performed after start of cranking in an engine until determination of a crank reference position, group injection which is performed after determination of a crank reference position until completion of stroke identification, and sequential injection which is performed after completion of stroke identification. The maximum period from simultaneous injection, after start of cranking, until simultaneously injected fuel is sucked into all cylinders #1 to #4 is set as an injection prohibition period t. The injection prohibition period t prevents "double injection," if group injection is started just after determination of a crank reference position and "injection failure," if the injection prohibition period is too long.

19 Claims, 11 Drawing Sheets

FUEL INJECTION CONTROL DEVICE FOR INTERNAL COMBUSTION ENGINE

CROSS-REFERENCE TO RELATED APPLICATIONS

The present application claims priority under 35 USC 119 to Japanese Patent Application No. 2005-241567 filed on Aug. 23, 2005 the entire contents of which are hereby incorporated by reference.

BACKGROUND OF THE INVENTION

1. Field of the Invention

The present invention relates to a fuel injection control device for an internal combustion engine and more particularly to a fuel injection control device for an internal combustion engine which ensures a stable carburetion condition at the start of the engine.

2. Description of Background Art

A fuel injection control device in an internal combustion engine performs a sequential injection in which fuel is injected in time with each intake stroke in each cylinder, in its normal operation. However, at the start of the internal combustion engine it is impossible to perform a sequential injection after the start of cranking until completion of the stroke identification because intake stroke timing is unknown. Therefore, it has been known that instead of a sequential injection, simultaneous injection is performed to supply fuel where fuel is injected into all cylinders at a time.

JP-A No. 280654/1989 discloses an electronically controlled fuel injector for an internal combustion engine in which after a start switch is turned on and cranking is started with a simultaneous injection being performed upon each crank rotation while the start switch is on. Thereafter, the start switch is turned off and a stroke identification is completed with a group injection being once performed where fuel is injected into each of several groups of cylinders, before proceeding to a sequential injection. This device can reduce the possibility of under-fueling or over-fueling for particular cylinders as compared with the approach that simultaneous injection is switched to sequential injection immediately after the start switch is turned off.

However, even with the technique disclosed in JP-A No. 280654/1989, injection timing in relation to the compression top dead center differs among cylinders in the simultaneous injection period before completion of the stroke identification. For this reason, a problem exists in that the condition of fuel carburetion differs among cylinders until completion of the stroke identification.

SUMMARY AND OBJECTS OF THE INVENTION

An object of the present invention is to solve the above problem with the prior art and provide a fuel injection control device for an internal combustion engine which ensures a more stable carburetion condition for each cylinder at the start of the internal combustion engine.

In order to achieve the above object, the present invention has a first feature wherein a fuel injection control device for an internal combustion engine includes crank angle detecting means for detecting the phase of a crankshaft of an internal combustion engine with a plurality of cylinders and stroke identifying means which identifies strokes of the plural cylinders. Fuel injection valves are provided on the plural cylinders that include injection switching means for selectively switching among simultaneous injection which is performed after the start of an internal combustion engine until a determination of a crank reference position by the crank angle detecting means. A group injection is performed after a determination of a crank reference position until completion of stroke identification by the stroke identifying means with sequential injection being performed after completion of the stroke identification.

Furthermore, an embodiment of the present invention provides a second feature of the injection prohibition means prohibits fuel injection for a prescribed period after the simultaneous injection is performed and provided.

Furthermore, an embodiment of the present invention provides a third feature wherein the injection prohibition means includes an injection prohibition period setting part which sets the prescribed period according to a signal from the stroke identifying means and injection prohibition command means for limiting operation of a fuel injector according to the set prescribed period.

Furthermore, an embodiment of the present invention provides a fourth feature wherein the prescribed period is set to the maximum period required for fuel injected by the simultaneous injection to be sucked into all the plural cylinders.

According to an embodiment of the present invention provides, since group injection is performed before completion of stroke identification, the accuracy of fuel injection timing in the internal combustion engine is better and variation in the carburetion condition among the cylinders is smaller than when simultaneous injection is repeated after an initial simultaneous injection until completion of stroke identification.

According to an embodiment of the present invention provides, the phenomenon of double injection which might occur if group injection is started just after determination of a crank reference position is prevented.

According to an embodiment of the present invention provides, since a period in which fuel injection is prohibited can be set according to a signal from the stroke identifying means, an adequate injection prohibition period can be obtained regardless of the rotation angle of the crankshaft at the start of the engine.

According to an embodiment of the present invention provides, since not only the above mentioned problem of double injection but also an injection failure, which means that fuel injection is not performed as needed, can be prevented, it is possible to enjoy the benefit of group injection that the accuracy of fuel injection timing is better and variation in the carburetion condition among the cylinders is smaller than in simultaneous injection.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
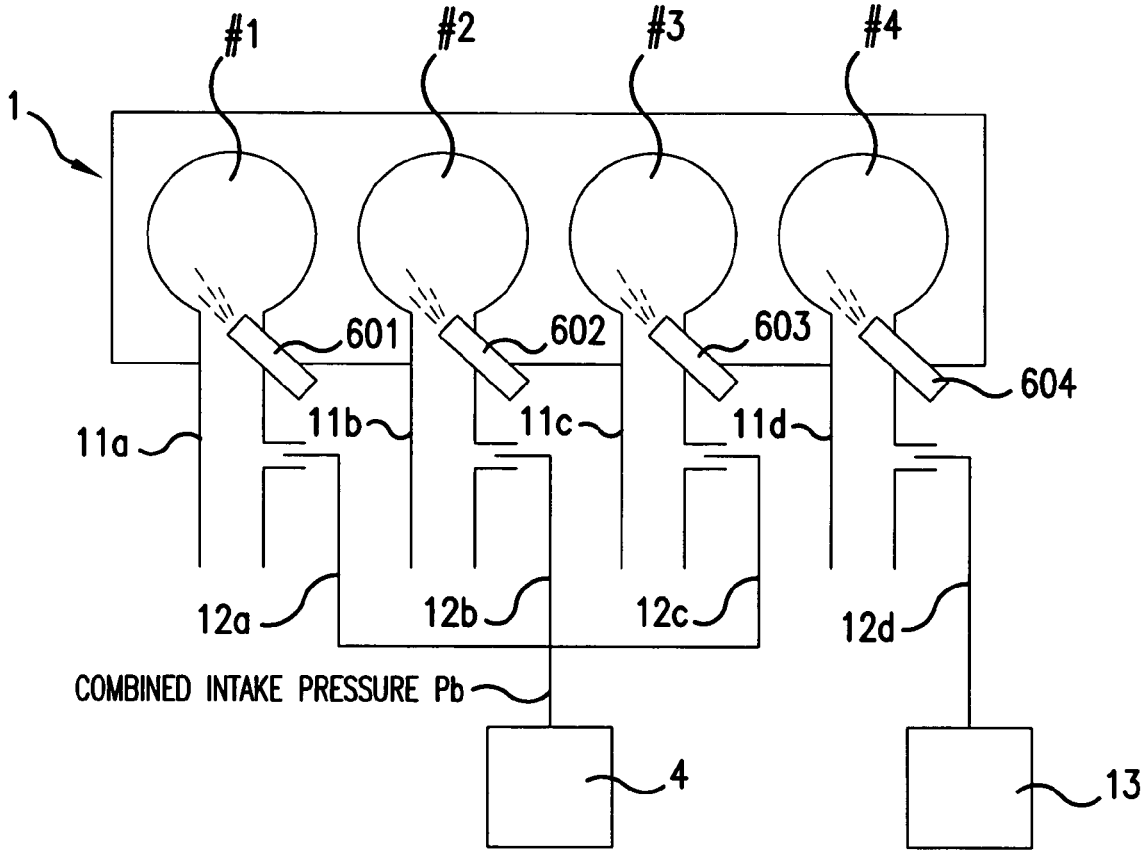
FIG. 1 is a schematic explanatory diagram of a 4-cycle 4-cylinder engine which is suitable for use of a fuel injection control device for an internal combustion engine according to the present invention.

Next, preferred embodiments of the present invention will be described in detail referring to drawings. FIG. 1 is a schematic explanatory diagram of a 4-cycle 4-cylinder engine which is suitable for use of a fuel injection control device for an internal combustion engine according to the present invention. In #1 to #4, the first to fourth cylinders of an engine 1 are provided with intake pipes 11*a* to 11*d* connected with intake ports that are in communication with ends of narrow tubes 12*a* to 12*d*, respectively The intake pipes 11*a* to 11*d* are provided with fuel injection valves 601 to 604 which control fuel injection into each of the cylinders. A Pb (intake pressure) sensor 4 is designed to detect a combined intake pressure which combines intake pressures P1, P2, and P3 generated in the first to third intake pipes 11*a* to 11*c* by joining the other ends of the first to third narrow tubes 12*a* to 12*c*. Since the waveform of combined intake pressure Pb thus measured is apparently different between the first rotation and second rotation of the crankshaft, stroke identification of the engine 1 can be made by analysis of this waveform. In addition, a second Pb sensor 13 for measuring intake pressure P4 of the intake pipe 11*d* is connected with one end of the narrow tube 12*d* of the fourth cylinder; however, the second Pb sensor 13 may be omitted if stroke identification is made based on the combined intake pressure Pb.

Figure 2:
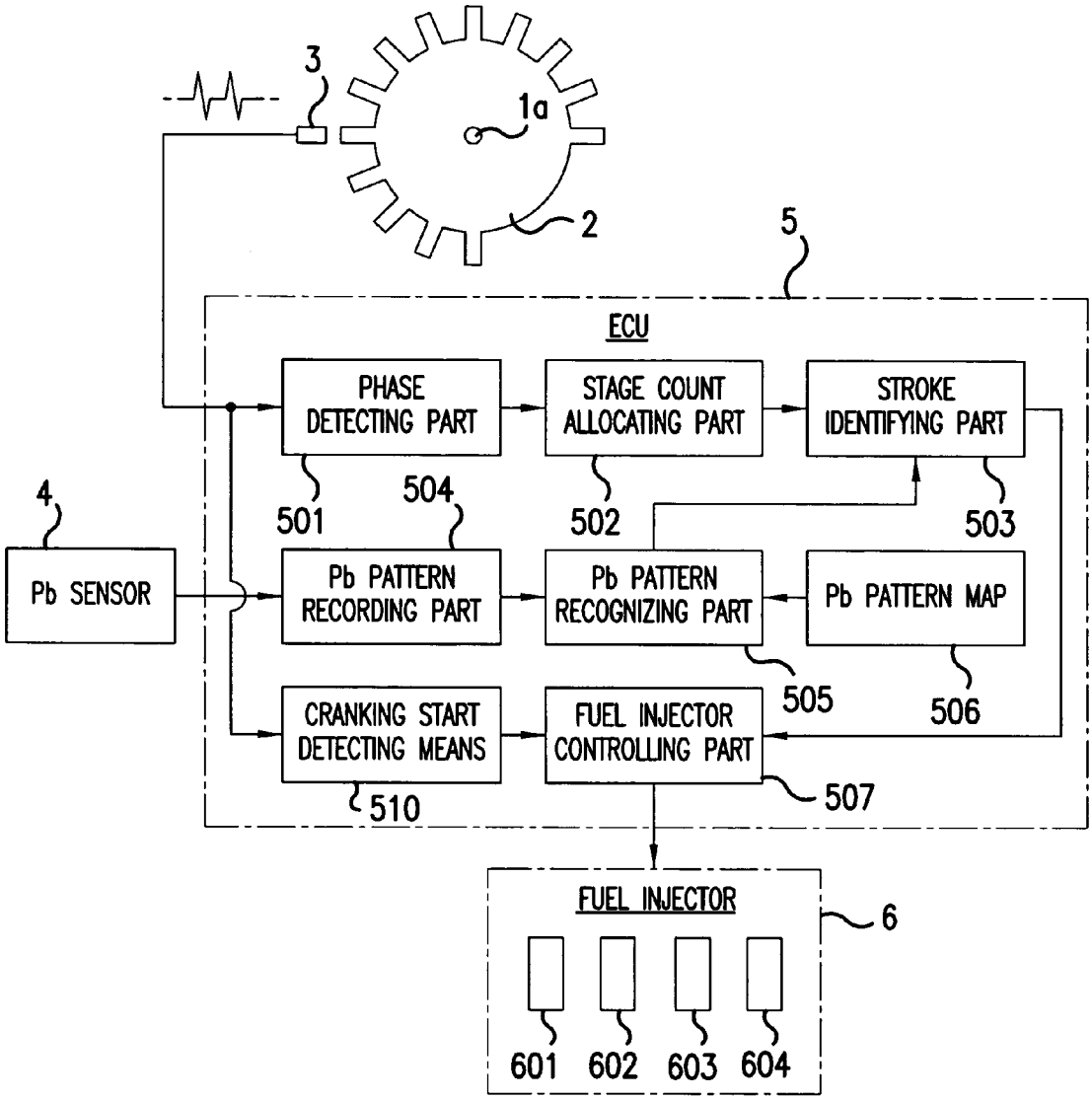
FIG. 2 is a block diagram of a fuel injection control device for an internal combustion engine according to an embodiment of the present invention.

FIG. 2 is a block diagram of a fuel injection control device for an internal combustion engine according to a first embodiment of the present invention. A crankshaft 1*a* of the engine 1 is provided with a pair of a crank pulsar rotor 2 including an untoothed portion, and a pulse generator 3, which output thirteen crank pulses upon each rotation thereof. The thirteen projections are spaced at intervals of 22.5 degrees and the angle of the untoothed portion is 90 degrees. The above crank pulses and an output signal of the Pb sensor 4 enter an ECU 5 together with other sensor signals, etc.

The ECU 5 includes a phase detecting part 501 as a crank angle detecting means for detecting the phase of the crankshaft 1*a* based on crank pulses, a stage count allocating part 502 which divides one crankshaft rotation into thirteen parts as crank pulse output timings and allocates stage numbers 0# to 12# to the respective crankshaft phases (stages), a Pb pattern recording part 504 which records the pattern of variation of the combined intake pressure Pb detected by the Pb sensor 4, a Pb pattern recognizing part 505 which recognizes a Pb pattern by checks against data stored in a Pb pattern map 506 and a stroke identifying part 503 as a stroke identifying means for identifying strokes of the engine 1, based on the results of the above stage count allocation and the above Pb pattern recognition. A fuel injector controlling part 507 controls opening/closing of fuel injection valves 601 to 604 of a fuel injector 6 at prescribed timings according to signals from a cranking start detecting means 510 and the stroke identifying part 503.

Figure 3A:
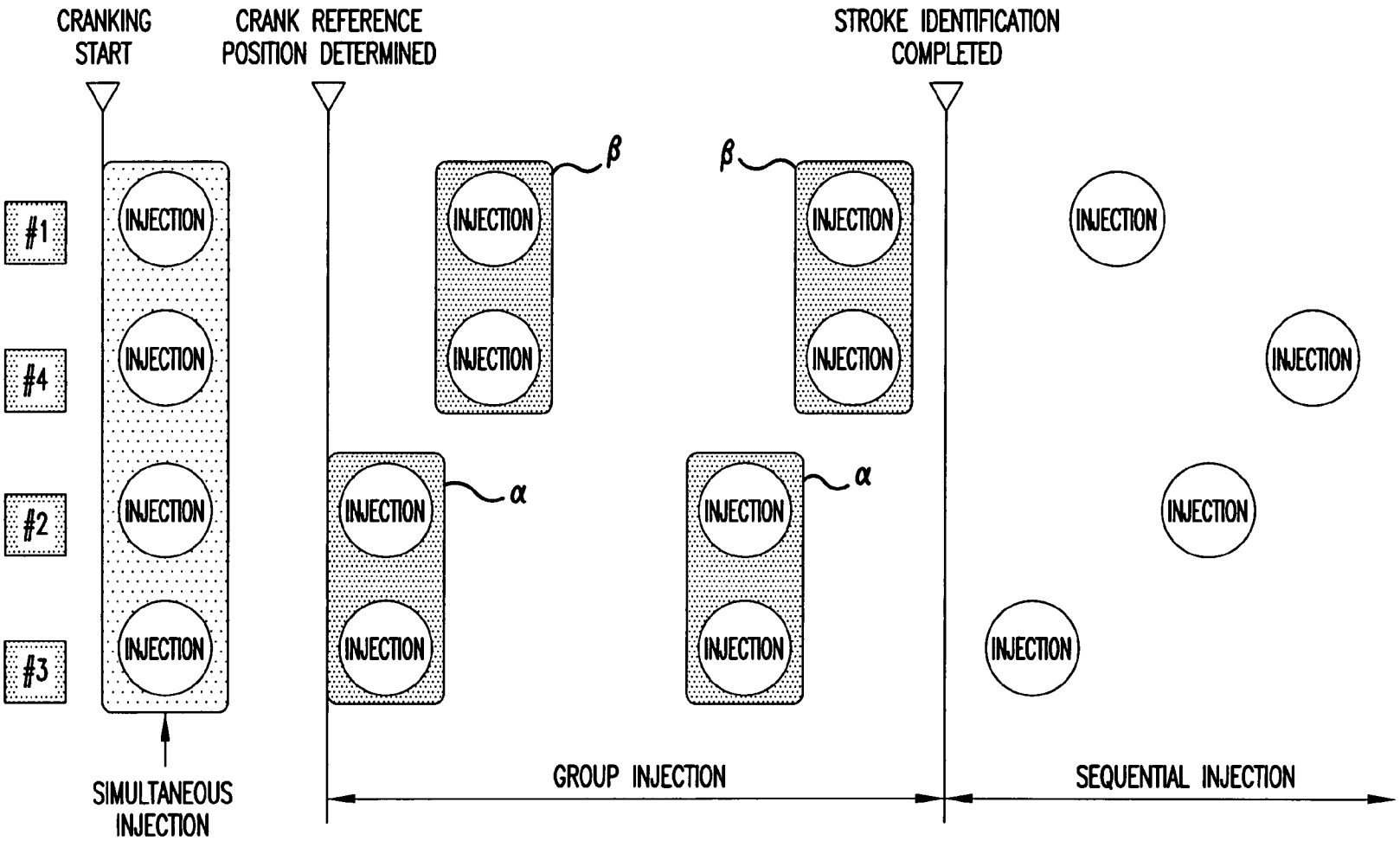
FIG. 3*a* is a schematic diagram showing a flow of fuel injection control according to a first embodiment of the present invention.

FIG. 3*a* shows an outline of fuel injection control which is carried out by a fuel injection control device for an internal combustion engine according to an embodiment of the present invention. In FIG. 3*a*, #1 to #4 represent the first to fourth cylinders of the engine 1. As cranking starts in the engine 1, the fuel injector controlling part 507 (see FIG. 2) performs simultaneous injection for #1 to #4. After this simultaneous injection, group injection for group α and group β is started. Here, regarding the two groups, #2 and #3 constitute one group and #1 and #4 constitute the other group, where intake strokes differ by 360 degrees of crankshaft rotation angle in each group. One injection is carried out every 720 degrees of crank rotation angle for each group, and as stroke identification is completed while this group injection is repeated, the cylinders serially shift to sequential injection in which fuel is injected in time with intake strokes of the cylinders. When all the four cylinders shift to sequential injection, fuel injection control according to the present invention is ended.

Figure 3B:
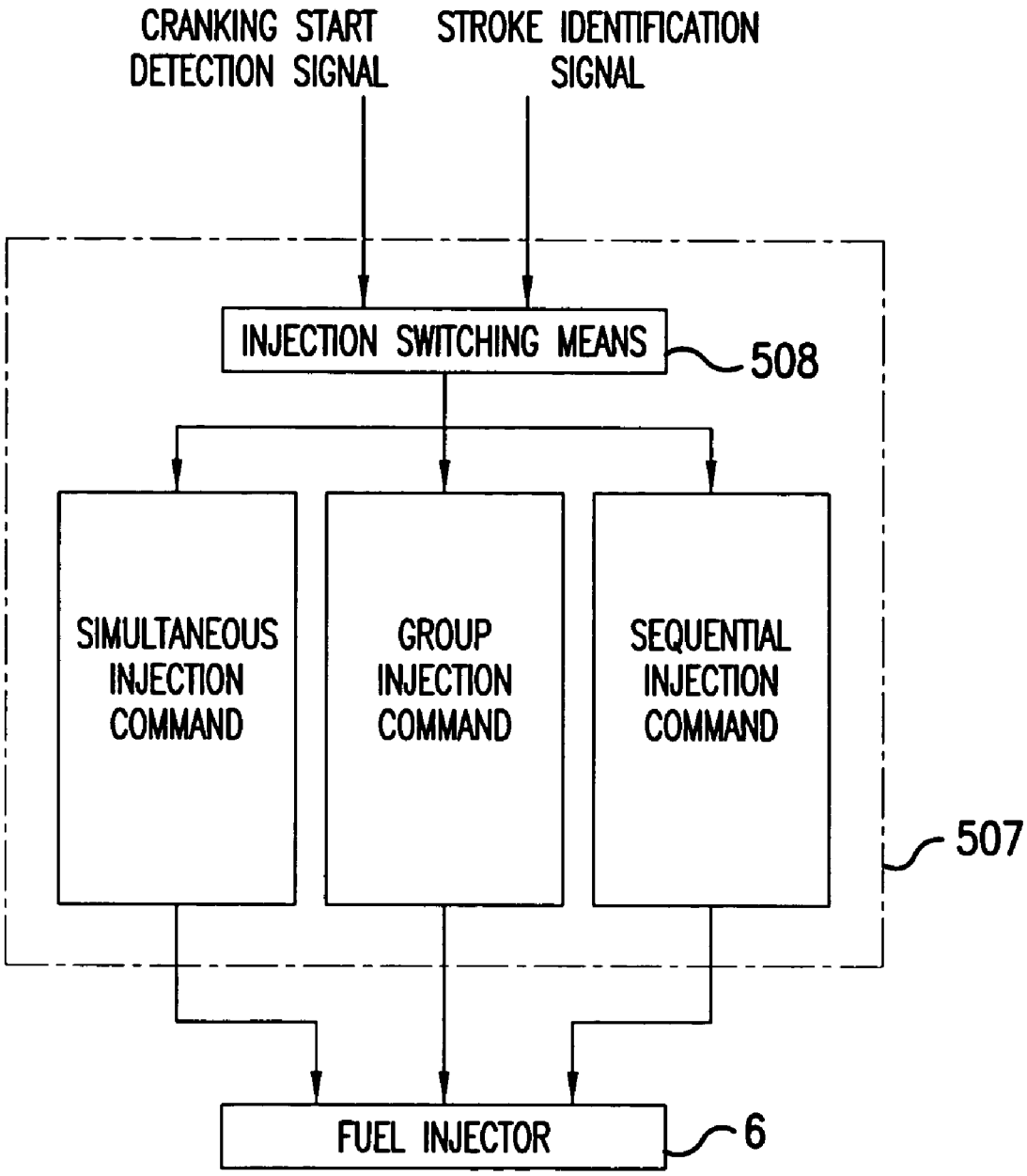
FIG. 3*b* is a detailed drawing of a fuel injector controlling part according to the first embodiment of the present invention.

FIG. 3*b* shows details of the fuel injector controlling part 507 (see FIG. 2) according to the present invention. The fuel injector controlling part 507 includes an injection switching means 508 for switching the injection mode of the fuel injector 6. This injection switching means 508 is designed to issue, as needed, an injection command which switches the injection mode of the fuel injector 6 to simultaneous injection in which fuel is injected into all cylinders at a time, group injection in which fuel injection is performed for one of several groups each consisting of plural cylinders, or sequential injection in which fuel injection is performed at each intake stroke timing for each cylinder, according to signals from the cranking start detecting means 510 and the stroke identifying part 503.

In ordinary engines, the right timing of fuel injection is at a given point before an intake stroke. However, the probability that fuel is injected at the right timing for a particular cylinder by simultaneous injection performed every crank rotation is low (usually, even in a multicylinder engine, fuel is injected at the right timing for only one cylinder). Therefore, in the method as used in the prior art that the simultaneous injection mode is used until completion of stroke identification, the period in which variation in the carburetion condition occurs would be lengthened. This embodiment intends to solve this problem by carrying out group injection before completion of stroke identification.

In the above group injection, if the engine 1 is a 180 degree crank parallel 4-cylinder engine, the right injection timing can be set for #3 of group α and #1 of group β. Therefore, although fuel injection is performed for #2 and #4 at timings different from the right timings for them by 360 degrees of crank rotation angle, it offers an advantage in that the fuel carburetion condition in the entire engine before stroke identification is definitely improved because fuel is injected at the right timing for half of all the cylinders.

However, in this embodiment, the phenomenon of double injection which destabilizes the carburetion condition due to over-fueling might occur depending on cranking start timing. An example of such a case is explained in reference to FIG. 9.

Figure 9:
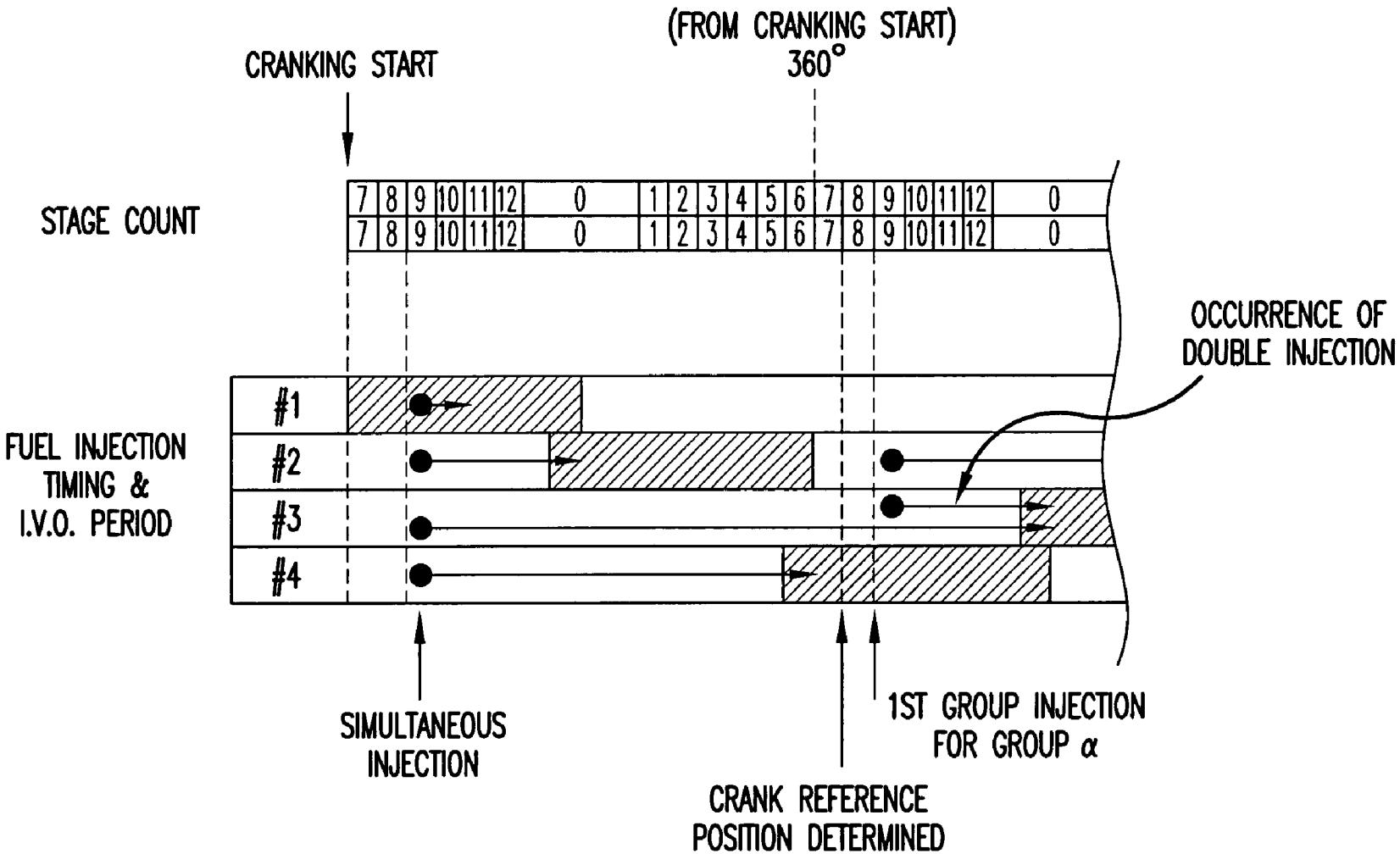
FIG. 9 is a timing chart showing a case where double injection occurs.

FIG. 9 is a timing chart showing a case that double injection occurs due to the above group injection. In FIG. 9, the stage count is a number indicating the crankshaft phase found by crank pulse measurement as mentioned above. In the example shown in FIG. 9, cranking starts at stage count 7 and simultaneous injection is performed at stage count 9. After this simultaneous injection, no injection is performed until a determination of a crank reference position because the right timing of group injection is unknown. Once a crank reference position is determined, the first group injection for group α is performed when stage count 9 is reached again. In this case, in the third cylinder, expressed by #3, the fuel from simultaneous injection remains on the back of the inlet valve and in the intake port and as a result of group injection, the fuel from the two injections accumulates there. An embodiment which takes this into consideration is described next.

Figure 4A:
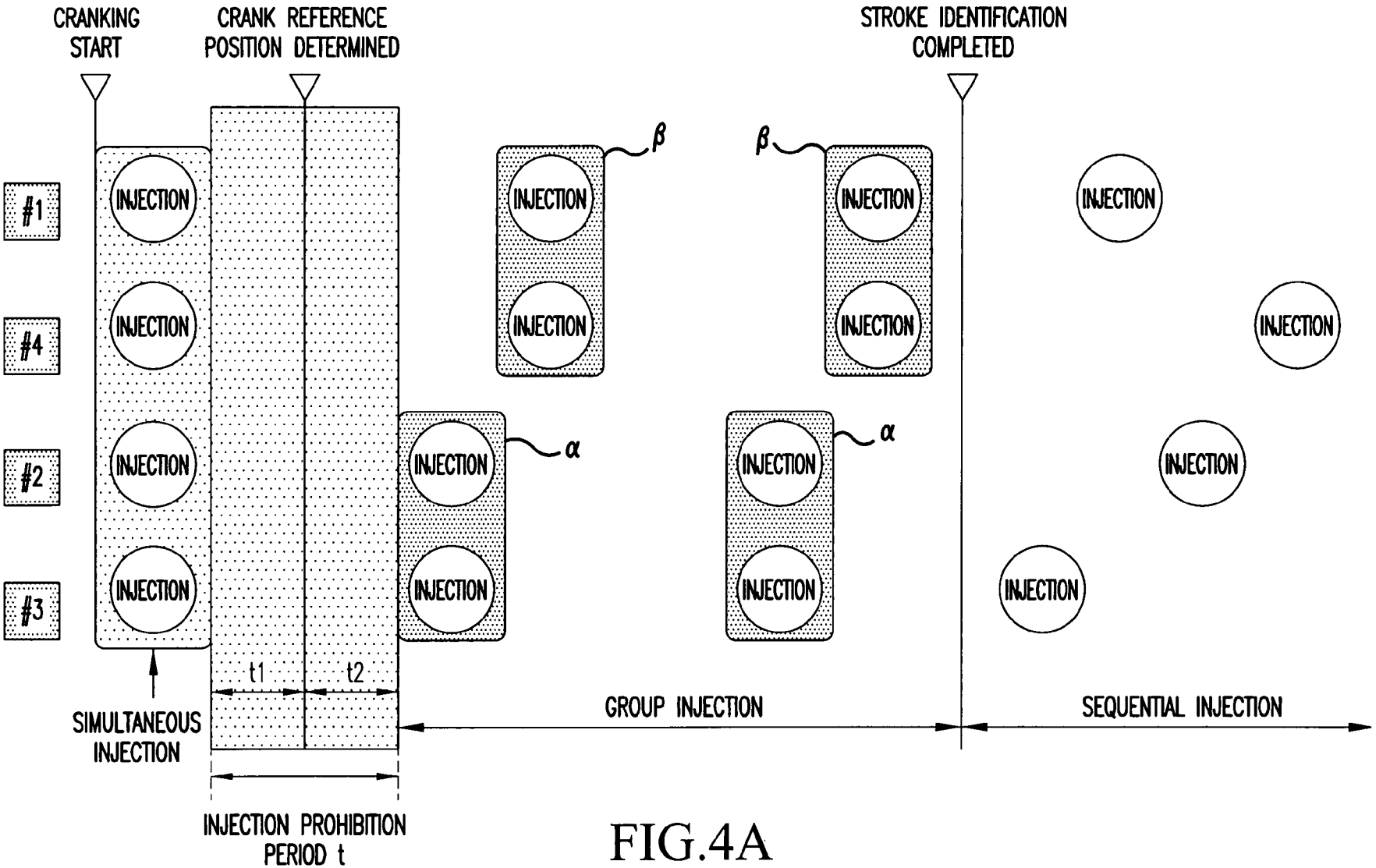
FIG. 4*a* is a schematic diagram showing a flow of fuel injection control according to a second embodiment of the present invention.

FIG. 4*a* is a schematic diagram showing fuel injection control by a fuel injection control device for an internal combustion engine according to a second embodiment of the present invention. The same reference numerals and symbols as above represent the same elements as above or equivalent elements. This embodiment is characterized in that after simultaneous injection is performed for #1 to #4 by the fuel injector controlling part 507, injection prohibition period t in which injection is not performed for any cylinder is set. This injection prohibition period t consists of period t1 from simultaneous injection until determination of a crank reference position and period t2 from determination of a crank reference position until start of group injection; after the injection prohibition period t2 has elapsed, group injection for group α and group β is started. Upon completion of stroke identification, the cylinders shift from group injection to sequential injection serially in the same way as in the first embodiment.

Figure 4B:
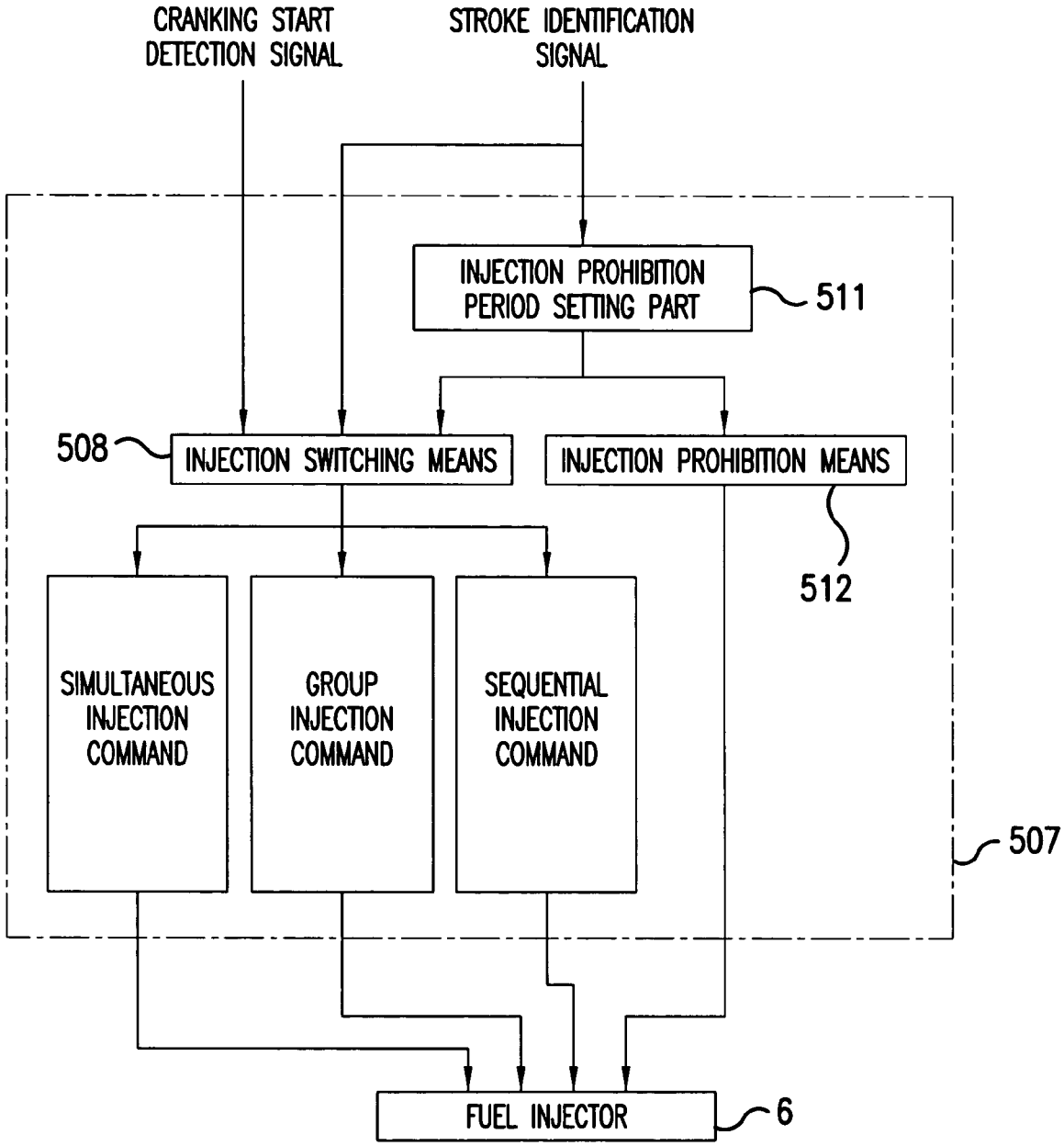
FIG. 4*b* is a detailed drawing of a fuel injector controlling part according to the second embodiment of the present invention.

FIG. 4*b* shows details of the fuel injector controlling part 507 (see FIG. 2). The same reference numerals and symbols as above represent the same elements as above or equivalent elements. This fuel injector controlling part 507 includes an injection switching means 508 for switching the injection mode of the fuel injector 6, and an injection prohibition means consisting of an injection prohibition period setting part 511 and an injection prohibition command means 512. The injection switching means 508 is designed to issue, as needed, an injection command which switches the injection mode of the fuel injector 6 to simultaneous injection, group injection, or sequential injection according to signals from the cranking start detecting means 510 and the stroke identifying part 503. The injection prohibition period setting part 511 sets injection prohibition period t according to a signal from the stroke identifying part 503 and transmits it to the injection prohibition command means 512. Then the injection prohibition command means 512 is designed to limit operation of the fuel injector 6 according to the injection prohibition period t as set above.

As described above, this embodiment is characterized in that there is a prescribed injection prohibition period t after simultaneous injection. In the injection prohibition period t, the period t1 before determination of a crank reference position is a period in which no injection should be performed and this injection prohibition period t extends to include a prescribed period t2 after determination of a crank reference position, thereby preventing double injection as mentioned above. On the other hand, if the injection prohibition period t should exceed 720 degrees in terms of crank rotation angle after simultaneous injection, an injection failure, or a situation that fuel injection as required is not performed, would occur, so its length should be carefully determined. Details of the injection prohibition period t will be discussed later.

Figure 5:
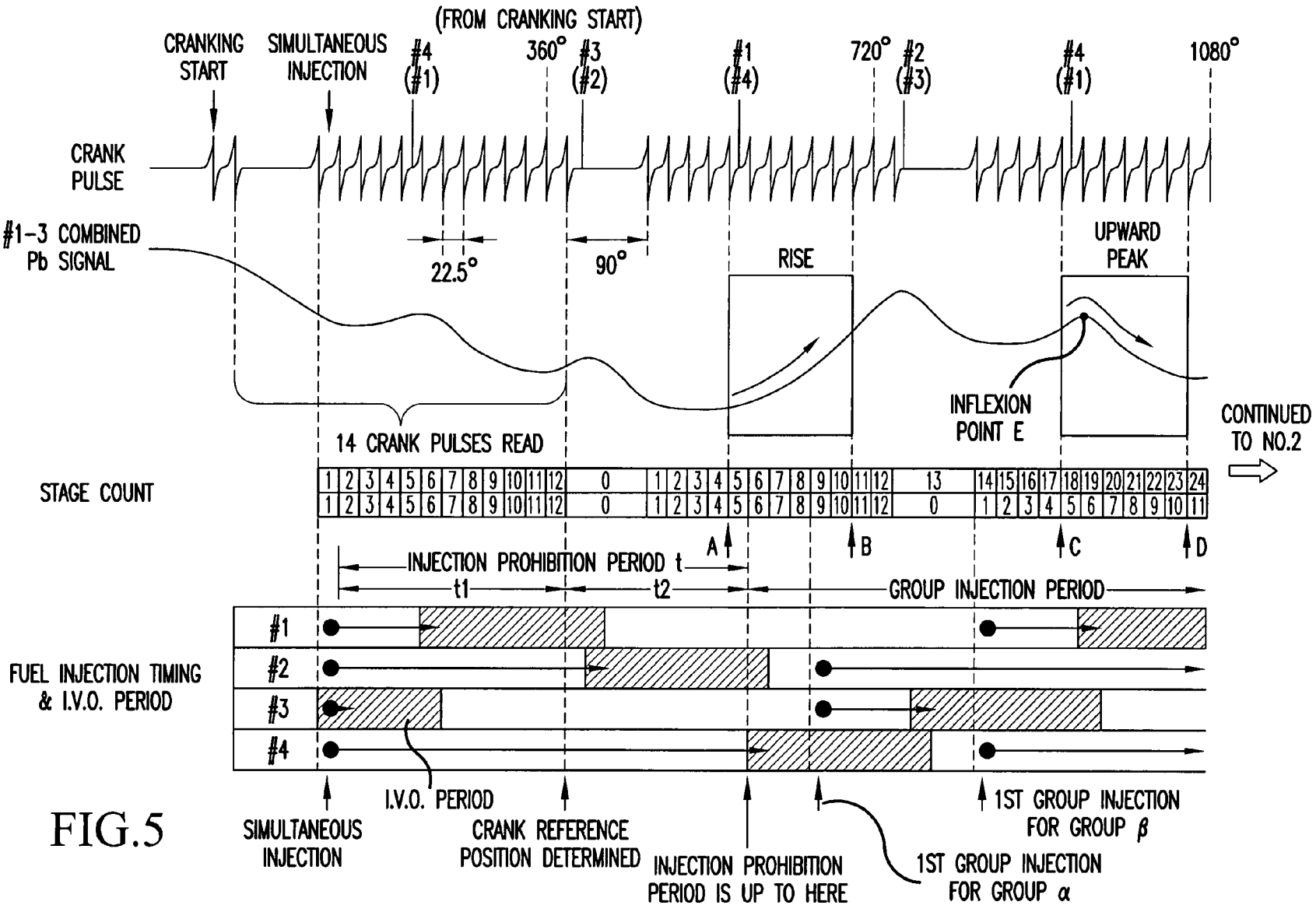
FIG. 5 is a timing chart (No. 1) showing the sequence of fuel injection control.
Figure 6:
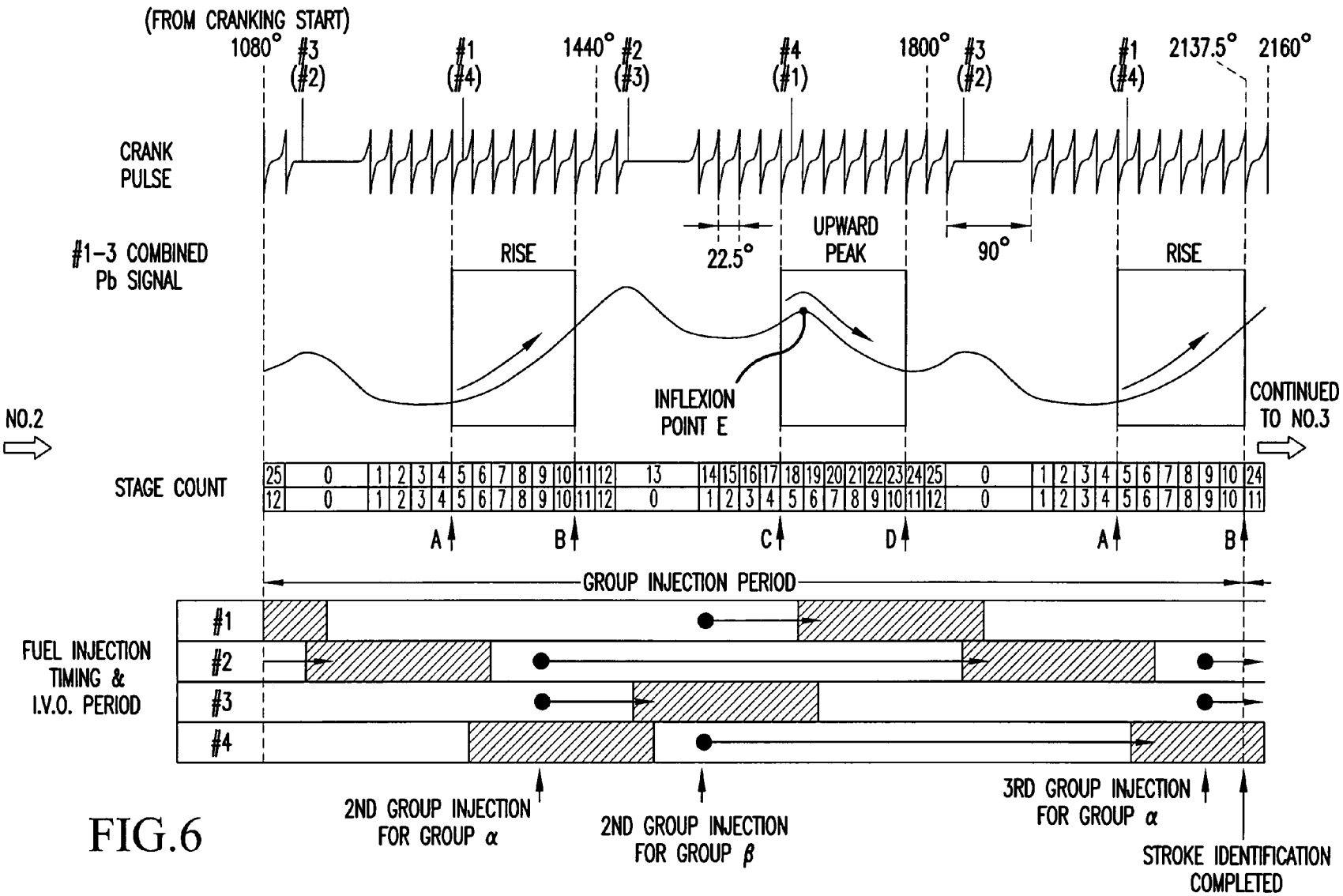
FIG. 6 is a timing chart (No. 2) showing the sequence of fuel injection control.
Figure 7:
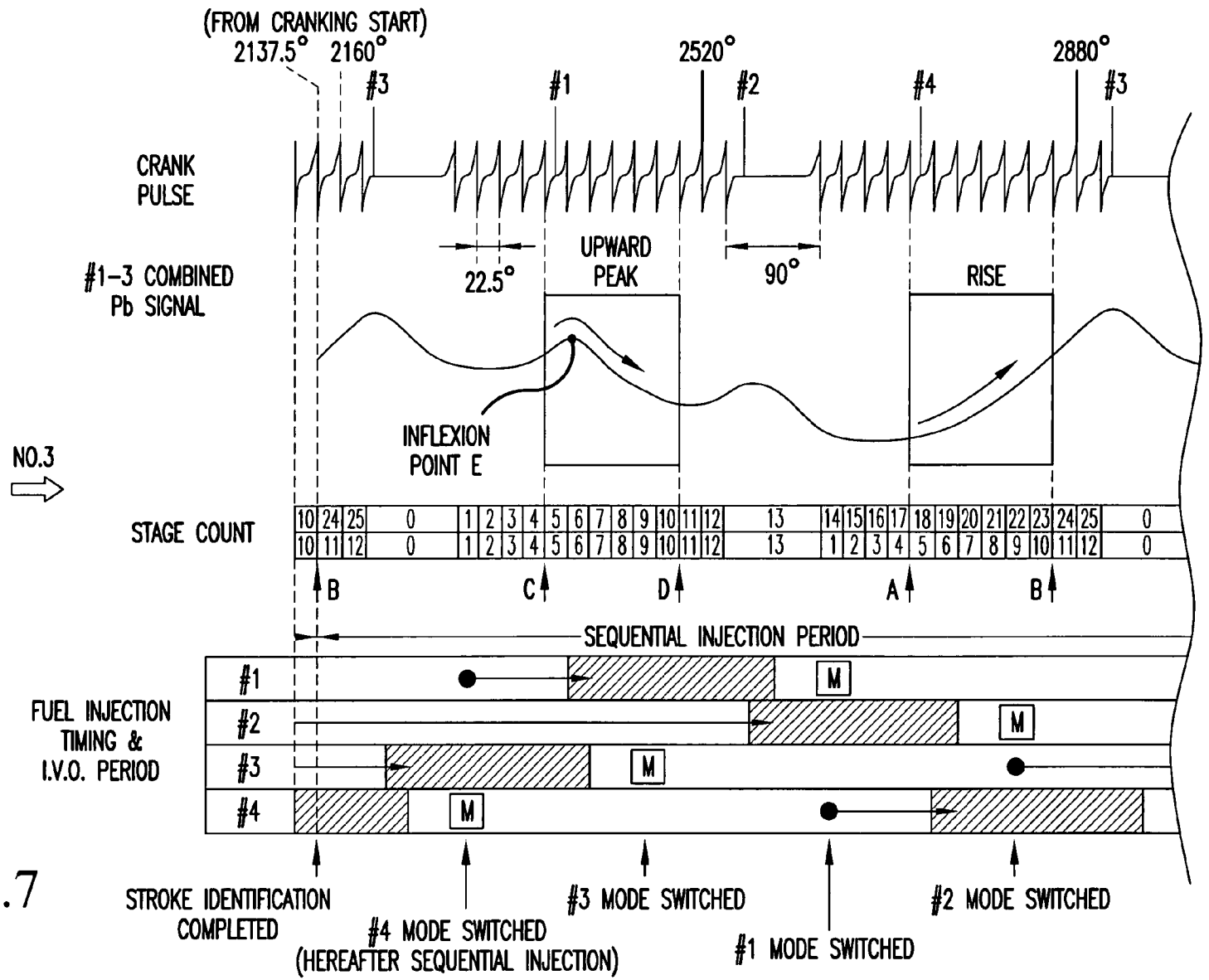
FIG. 7 is a timing chart (No. 3) showing the sequence of fuel injection control.

Next, prior to a detailed description of the injection period t, the method of stroke identification by the above mentioned Pb pattern recognition is described referring to the consecutive timing charts in FIGS. 5 to 7.

As shown in FIG. 5, as cranking starts, the phase detecting part 501 (see FIG. 2) starts detecting crank pulses. In this embodiment, upon detection of fourteen crank pulses, a crank reference position is determined and stage count measurement becomes possible. This is because the untoothed portion of the crank pulse rotor 2 as a rotation reference position is necessarily passed while fourteen crank pulses are detected. In FIG. 5, stage counts from the time of simultaneous injection until determination of a crank reference position are shown for illustrative purposes.

In this embodiment, stroke identification is made by the Pb pattern recognizing part 505 making a pattern recognition of the waveform of combined intake pressure Pb of the first to third cylinders. This embodiment is designed so that stroke identification is made between stage counts 5 and 10, namely A-B zone (in the first rotation) and C-D zone (in the second rotation) and Pb pattern recognition is made by identifying which one the pattern of combined intake pressure Pb waveform is between two patterns: "rise", and "upward peak" with an inflexion point E.

In this embodiment, the Pb pattern in the stage count A-B zone is recognized as "rise" and the Pb pattern in the C-D zone after one crank rotation is recognized as "upward peak." Subsequent Pb patterns are recognized as "rise" and "upward peak" in alternate turns repeatedly as far as the engine 1 normally operates, and when the number of consecutive Pb pattern recognitions reaches a prescribed number, the stroke identifying part 503 (see FIG. 2) identifies engine strokes. In this embodiment, the above prescribed number is set to 5 and when rotation has been made by 2137.5 degrees after start of cranking, stroke identification is completed (see FIG. 6). Consequently, regarding the compression top dead center for the first to fourth cylinders, expressed by #1 to #4 in the upper portions of the time charts in FIGS. 5 to 7, which one of the upper and lower # symbols is right, in other words, which one represents right/wrong recognition mistaken by 360 degrees in terms of crankshaft phase is unknown before completion of stroke identification; on the other hand, after completion of stroke identification, it is known that the symbol # in parentheses (lower symbol) represents "right" or while the symbol # with no parentheses (upper symbol) represents "wrong."

Details of fuel injection control by the fuel injection control device for an internal combustion engine according to the present invention are described below referring to the timing charts in FIGS. 5 to 7 and the flowchart in FIG. 8. In the table "Fuel Injection Timing and I.V.O Period" of the timing charts in FIGS. 5 to 7, a shaded area denotes an I.V.O (Inlet Valve Open) period, or a period in which the inlet valve is open. In this embodiment, an I.V.O. period is set to 202.5 degrees and injected fuel is sucked into a cylinder when fuel injection starts during the first half of the I.V.O. period from the start of the I.V.O. period where the peak of valve lift is the point of division. Also, a black circle mark represents injection timing and a right arrow which follows a black circle mark indicates a period in which injected fuel stays on the back of the inlet valve and in the intake port without being sucked into the cylinder.

Figure 8:
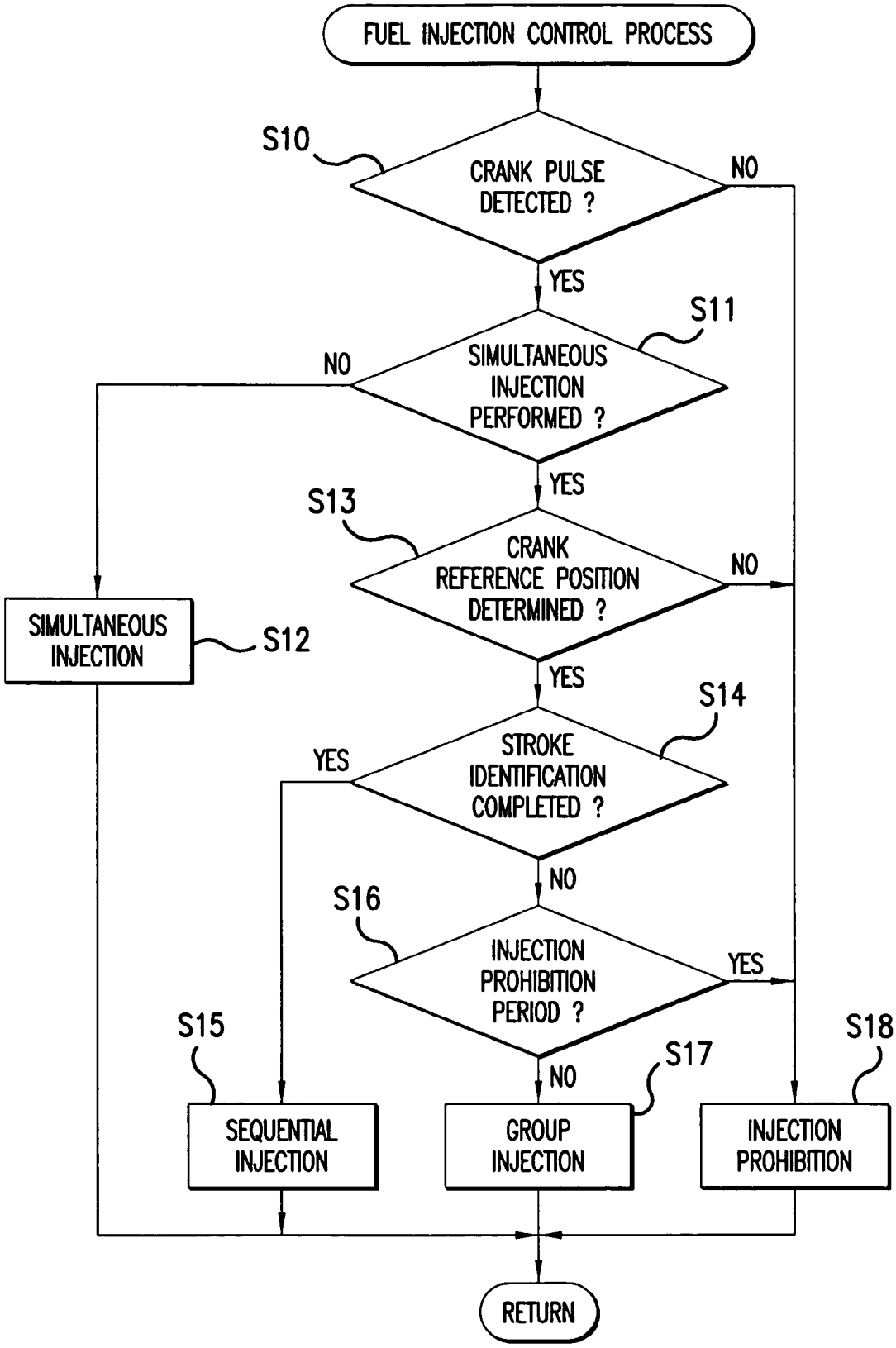
FIG. 8 is a flowchart showing the sequence of fuel injection control.

As cranking starts in order to start the engine 1, a "fuel injection control process" as shown in the flowchart of FIG. 8 is started. This fuel injection control process is repeated cyclically in a prescribed manner until sequential injection which will be described later is performed. At step S10, whether a crank pulse has been detected or not by the phase detecting part 501 is decided, and if it is decided that a crank pulse has been detected, the sequence proceeds to step S11. At step S11, whether simultaneous injection has been performed or not is decided and if it is decided that simultaneous injection has not been performed, the sequence proceeds to step S12 where simultaneous injection is performed. This embodiment is designed so that when a second pulse is detected after start of cranking, simultaneous injection is performed. As shown in the time chart of FIG. 5, as the crank rotates, simultaneously injected fuel is sucked into each of the cylinders in the following order: #3, #1, #2 and #4. Here, for #3, simultaneous injection timing is in the first half of an I.V.O. period, so that injected fuel is immediately sucked into the cylinder.

Going back to FIG. 8, if it is decided at step S11 that simultaneous injection has been performed, the sequence proceeds to step S13 where a decision is made as to whether a crank reference position has been determined or not. If it is decided here that a crank reference position has not been determined, fuel injection is prohibited at step S18 as when it is decided at step S10 that a crank pulse has not been detected. On the other hand, if it is decided at step S13 that a crank reference position has been determined, whether stroke identification has been made or not is decided at the next step S14. If it is decided at step S14 that stroke identification has not been made, the sequence proceeds to step S16 where a decision is made as to whether it is in the injection prohibition period t or not. On the other hand, if it is decided that stroke identification has been made, the sequence proceeds to step S15 for sequential injection and the fuel injection control process is ended.

As described above, a prescribed injection prohibition period t after simultaneous injection is given by the fuel injection prohibition means consisting of the injection prohibition period setting part 511 and the injection prohibition command means 509. As indicated in the time chart of FIG. 5, the injection prohibition period t is defined as a period from input of the first crank pulse after simultaneous injection until crank rotation by 450 degrees is completed. Here, period t1 corresponds to 247.5 degrees and period t2 corresponds to 202.5 degrees. This injection prohibition period t is a period which is required to reach the start point of the I.V.O. period for #4, a cylinder for which the period up to the start point of the I.V.O. period is the longest at the time of simultaneous injection, namely the maximum period required for all simultaneously injected fuel to be sucked into the cylinders. Therefore, the injection prohibition period t varies according to the crank rotation angle at the start of cranking; in this embodiment, it is maximum when simultaneous injection is performed at the middle point of an I.V.O. period (the moment the inlet valve lift peaks and suction of fuel into the cylinder stops). As described above, fuel injection control by the fuel injection control device for an internal combustion engine according to the present invention sets this injection prohibition period t so that group injection is performed without causing double injection or an injection failure.

Going back to the flowchart in FIG. 8, if it is decided at step S16 that it is in the injection prohibition period t, the sequence proceeds to step S18 where fuel injection is prohibited. On the other hand, if it is decided that it is not in the injection prohibition period t, the sequence proceeds to step S17 where group injection is performed. Whichever step is taken, the fuel injection control according to this flowchart is repeated until sequential injection at step S15 is performed.

Referring to the timing chart in FIG. 7, control for transition from group injection to sequential injection after stroke identification is explained next. In this embodiment, stroke identification is completed when 2137.5 degrees of crank rotation angle is reached after start of cranking, which reveals that right/wrong recognition of stages has been mistaken by 360 degrees before completion of stroke identification. This mistaken recognition is corrected by changing the upper stage count number (reversing right/wrong). More specifically, the stage count after the above mentioned point of 2137.5 degrees is changed to 24 instead of 11. After this, at the next group injection timing for group β, for #1, group injection is performed because it is the right timing for #1, but for #4, for which it is not the right timing, group injection is not performed but the mode is switched from group injection to sequential injection. Next, at stage 9, the mode is switched to sequential injection for #3. Then, at stage 14, the mode is switched to sequential injection for #1, and at stage 22, for #2; mode switching to sequential injection is thus finished for all the four cylinders.

As explained above, according to the fuel injection control device for an internal combustion engine according to the present invention, since the maximum period required for simultaneously injected fuel to be all sucked into the cylinders is an injection prohibition period, even when group injection is performed before stroke identification, double fuel injection or an injection failure does not occur. Consequently, group injection just offers an advantage and the accuracy of fuel injection timing before stroke identification is improved and consequently variation in the carburetion condition among the cylinders is reduced.

In connection with the above embodiments, application to a 4-cycle parallel 4-cylinder engine with a 180 degree crank has been so far explained. However, obviously the invention may be applied to other various types of 4-cycle engines. Also, apparently the stroke identification method and the like are not limited to those used in the above embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection control device for an internal combustion engine comprising:

crank angle detecting means for detecting the phase of a crankshaft of an internal combustion engine with a plurality of cylinders;

stroke identifying means which identifies strokes of the plurality of cylinders;

fuel injection valves provided on the plurality of cylinders; and injection switching means for selectively switching among:

simultaneous injection which is performed after start of an internal combustion engine until determination of a crank reference position by the crank angle detecting means;

group injection which is performed after determination of a crank reference position until completion of stroke identification by the stroke identifying means; and sequential injection which is performed after completion of the stroke identification, the fuel injection control device further comprising injection prohibition means for prohibiting fuel injection for a prescribed period after the simultaneous injection is performed.

2. The fuel injection control device for an internal combustion engine according to claim 1, wherein the injection prohibition means comprises an injection prohibition period setting part for setting the prescribed period according to a signal from the stroke identifying means and injection prohibition command means for limiting operation of a fuel injector according to the set prescribed period.

3. The fuel injection control device for an internal combustion engine according to claim 2, wherein the prescribed period is set to the maximum period required for fuel injected by the simultaneous injection to be sucked into all the plurality of cylinders.

4. The fuel injection control device for an internal combustion engine according to claim 1, wherein the prescribed period is set to the maximum period required for fuel injected by the simultaneous injection to be sucked into all the plurality of cylinders.

5. The fuel injection control device for an internal combustion engine according to claim 1, wherein the crank angle detecting means detects the phase of the crankshaft based on crank pulses and further including a stage count allocating part for dividing one crankshaft rotation into thirteen parts as crank pulse output timings and allocates stage number to the respective crankshaft phases.

6. The fuel injection control device for an internal combustion engine according to claim 5, wherein the stage count allocating part divides one crankshaft rotation into thirteen parts as crank pulse output timings with the use of thirteen toothed portions while an untoothed portion identifies a fourteen crank pulse.

7. The fuel injection control device for an internal combustion engine according to claim 1, wherein the stroke identifying means completes an identification of stroke when 2,137.5 degrees of crank rotation angle is reached after start of cranking.

8. The fuel injection control device for an internal combustion engine according to claim 1, wherein the stage count allocating part divides one crankshaft rotation into thirteen parts as crank pulse output timings with the use of thirteen toothed portions while an untoothed portion identifies a fourteen crank pulse.

9. A fuel injection control device for an internal, combustion engine comprising:

crank angle detecting means for detecting the phase of a crankshaft of an internal combustion engine with a plurality of cylinders;

stroke identifying means which identifies strokes of the plurality of cylinders;

fuel injection valves provided on the plurality of cylinders; and injection switching means for selectively switching among:

simultaneous injection which is performed after start of an internal combustion engine until determination of a crank reference position by the crank angle detecting means;

group injection which is performed after determination of a crank reference position until completion of stroke identification by the stroke identifying means; and sequential injection which is performed after completion of the stroke identification, the fuel injection control device for an internal combustion engine further comprising:

a pattern recording part for recording the pattern of variation of a combined intake pressure detected by a sensor and a pattern recognizing part for recognizing a pattern by checks against data stored in a pattern map.

10. The fuel injection control device for an internal combustion engine according to claim 9, wherein the stroke identifying means identifies strokes of the engine based on results of the stage count allocation and the pattern recognition.

11. A fuel injection control device for an internal combustion engine comprising:

a crank angle detector detecting the phase of a crankshaft of an internal combustion engine with a plurality of cylinders;

a stroke identifier identifying strokes of the plurality of cylinders;

fuel injection valves provided on the plurality of cylinders; and an injection switch selectively switching among:

simultaneous injection which is performed after start of an internal combustion engine until determination of a crank reference position by the crank angle detector;

group injection which is performed after determination of a crank reference position until completion of stroke identification by the stroke identifier; and sequential injection which is performed after completion of the stroke identification the fuel injection control device for an internal combustion engine further comprising:

a stage count allocating part for dividing one crankshaft rotation into thirteen parts as crank pulse output timings and allocates stage number to the respective crankshaft phases.

12. The fuel injection control device for an internal combustion engine according to claim 11, and further including an injection prohibitor prohibiting fuel injection for a prescribed period after the simultaneous injection is performed.

13. The fuel injection control device for an internal combustion engine according to claim 12, wherein the injection prohibitor comprises an injection prohibition period setting part for setting the prescribed period according to a signal from the stroke identifying means and injection prohibition command means for limiting operation of a fuel injector according to the set prescribed period.

14. The fuel injection control device for an internal combustion engine according to claim 13, wherein the prescribed period is set to the maximum period required for fuel injected by the simultaneous injection to be sucked into all the plurality of cylinders.

15. The fuel injection control device for an internal combustion engine according to claim 12, wherein the prescribed period is set to the maximum period required for fuel injected by the simultaneous injection to be sucked into all the plurality of cylinders.

16. The fuel injection control device for an internal combustion engine according to claim 11, wherein the crank angle detector detects the phase of the crankshaft based on crank pulses.

17. The fuel injection control device for an internal combustion engine according to claim 16, and further including a pattern recording part for recording the pattern of variation of a combined intake pressure detected by a sensor and a pattern recognizing part for recognizing a pattern by checks against data stored in a pattern map.

18. The fuel injection control device for an internal combustion engine according to claim 17, wherein the stroke identifier identifies strokes of the engine based on results of the stage count allocation and the pattern recognition.

19. The fuel injection control device for an internal combustion engine according to claim 11, wherein the stroke identifier completes an identification of stroke when 2,137.5 degrees of crank rotation angle is reached after start of cranking.

* * * * *